United States Patent [19]

Heckel

[11] 4,381,754

[45] May 3, 1983

[54] ELECTROMAGNETIC FUEL SAVING DEVICE

[76] Inventor: Karl Heckel, 1515 Ward Ave., Apt. 1403, Honolulu, Hi. 96822

[21] Appl. No.: 302,211

[22] Filed: Sep. 14, 1981

[51] Int. Cl.[3] ..... F02M 27/00

[52] U.S. Cl. ..... 123/538; 123/536

[58] Field of Search ..... 123/536, 537, 538, 539; 210/222; 431/356

[56] References Cited

U.S. PATENT DOCUMENTS

| | | | |
|---|---|---|---|
| 3,116,726 | 1/1964 | Kwartz | 123/538 |
| 3,976,726 | 8/1976 | Johnson | 123/536 |
| 4,050,426 | 9/1977 | Sanderson | 123/538 |
| 4,265,755 | 5/1981 | Zimmerman | 270/222 |
| 4,299,701 | 11/1981 | Garrett | 210/222 |

*Primary Examiner*—Ronald H. Lazarus

*Attorney, Agent, or Firm*—George W. T. Loo

[57] ABSTRACT

An electromagnetic fuel saving device for internal combustion engines. The device includes two electromagnetic assemblies and two connectors. Each electromagnetic assembly includes a coil, a spool, an insulating tape, a casing, a core, two studs, and two terminals. The coil is wound around the spool and is covered by the insulating tape. The casing encloses the coil, the spool, and the insulating tape. The core is pivotally mounted within the spool cylinder and extends on either side of the spool. A stud is connected to each end portion of the core. The terminals are connected to the coil and are adapted to be used to operatively connect the coil to a battery. Two electromagnetic assemblies are installed on a fuel line in opposing relationship by aligning them so that they contact the periphery of the fuel line, by connecting them with the two connectors, and by operatively connecting them in parallel to a 12 volt direct current circuit. When so installed, there is a gap between the opposing studs. This gap gives a complete, unbroken pinpoint magnetic flux field through the fuel as it flows through the fuel line. This device results in fuel efficiency of from 15% to 30%.

8 Claims, 6 Drawing Figures

ELECTROMAGNETIC FUEL SAVING DEVICE

BACKGROUND OF THE INVENTION

1. Field of Invention

This invention relates to the electromagnetic treatment of liquid fuel in an internal combustion engine for greater fuel efficiency.

2. Description of the Prior Art

Present electromagnetic devices for internal combustion engines such as Kwartz (U.S. Pat. No. 3,116,726, dated Jan. 7, 1964) and Reece (U.S. Pat. No. 3,989,017, dated Nov. 2, 1976) are expensive to manufacture and complicated for the average driver to use. Moreover, they can generally be used only with gasoline engines, not with diesel engines. My invention is inexpensive to manufacture and easy for the average driver to use. My invention is designed to pass an intense magnetic flux field in a pinpoint manner through the fuel. It uses a negligible amount of current and does not interfere with the ignition or operation of any engine. It may be used with gasoline or diesel engines.

3. Disclosure Statement

Kwartz discloses an impedance device 10 which is mounted by means of spring clips K and N onto a fuel line L between carburetor 12 and fuel pump 14. It is electrically connected to the high-tension ignition system of an internal combustion engine between the ignition coil 21 and distributor. When the primary circuit of coil 21A is broken, a pulsating current is sent through coils C and E of impedance device 10 to establish a high intensity magnetic field about the coils. The fuel in fuel line L is subjected to the high intensity magnetic field. The presence of the coils in the ignition circuit increases the length of discharge or hotness of the spark within the engine cylinder resulting in improved in improved combustion and engine efficiency. Coils C and E are made with special high resistance wire and utilize a very high voltage from ignition coil 21. It is designed to be effective with a brass fuel line so that there will be no short circuit path for the flux line of the magnetic field. A thermostat P may be connected at the junction of coils C and E to vary the inductance in the high-tension ignition system in response to the operating condition of the engine.

Kwartz's device requires an ignition coil in order to operate. Since a diesel engine has no ignition coil, Kwartz's device cannot be used with a diesel engine.

My invention is designed for use with a diesel engine as well as a gasoline engine. My invention is based on basic coil winding techniques. It utilizes a very low potential direct current voltage with no high voltage build-up. The principle of my invention is to pass an intense magnetic flux field in a pinpoint manner through the fuel. My invention in no way interferes with the ignition or operation of any engine. My invention is effective on any type of fuel line and requires no thermostat as it in no way interferes with normal engine operation.

SUMMARY OF THE INVENTION

This invention relates to an electromagnetic fuel saving device for use on the fuel line of an internal combustion engine.

An object of this invention is to provide an electromagnetic fuel saving device for an internal combustion engine which is simple to manufacture and easy to use.

Another object of this invention is to provide an electromagnetic fuel saving device for an internal combustion engine which may be used with a gasoline engine or a diesel engine.

A further object of this invention is to provide an electromagnetic fuel saving device for an internal combustion engine which uses a negligible amount of current and does not interfere with the ignition or operation of any engine.

Still another object of this invention is to provide an electromagnetic fuel saving device for an internal combustion engine which can be readily installed on the fuel line of the engine and which is relatively maintenance free.

Other objects, features and advantages of the present invention will be readily apparent from the following detailed description taken in connection with the accompanying drawings.

DESCRIPTION OF THE PREFERRED EMBODIMENT

Figure 1:
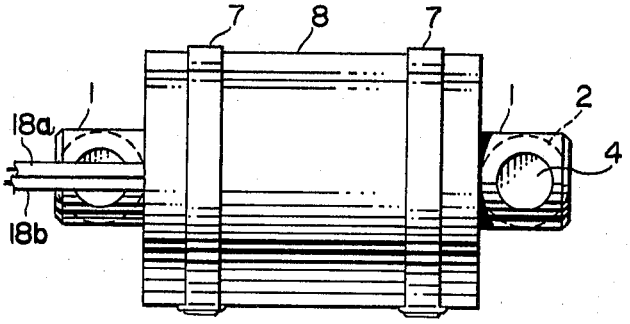
FIG. 1 is a top plan view of the electromagnetic fuel saving device.

Before explaining the present invention in detail it is to be understood that the invention is not limited in its application to the details of construction and arrangements of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings wherein like reference numerals refer to like and corresponding parts throughout the several views, the preferred embodiment of the invention disclosed in FIGS. 1–4 and 6 inclusive includes two electromagnetic assemblies and two connectors.

Each electromagnetic assembly includes a core 1, 2 studs 2, a coil 19, and a casing 8. Core 1 has two spaced holes 3 located in its end portions. Core 1 is circular in cross section and is made of soft iron.

Stud 2 has a reduced end portion 4, a middle portion, and a concave end portion 5. Reduced end portion 4 is machined so that it will fit within hole 3 and can not be taken out of hole 3 once it is inserted within hole 3. End portion 5 has a curved surface located between two flat surfaces. The curved surface is machined to fit the periphery of a fuel line F. Depending on the size of the fuel line it is to be used with, it may have a diameter of $\frac{1}{4}''$, $\frac{3}{8}''$, or $\frac{1}{2}''$. It may have only the larger diameter, if it is deem desirable. Stud 2 is circular in cross section and is made of soft iron.

Coil 19 is a specially wound coil of 1,700 turns of 25 gauge Brau and Sharp standard magnet wire. It is wound around spool cylinder 17 and wound within spool rims 16. Coil 19 is covered by coil winding insulation tape 15. Coil 19 has a set of leads (18*a* and 18*b* or 18*c* and 18*d*) which allows for installation variations according to supply voltages. For 12 volt direct current, the leads 18*a* and 18*b* and 18*c* and 18*d* are connected in parallel; for 24 volt direct current, the leads are connected in series. See FIG. 5 for parallel connection. Instead of a set of leads, two pins which stick out or terminals may be used.

Casing 8 has a curved end portion, a middle portion, and a concave end portion. The concave end portion includes a curved surface 9 and two flat surfaces 10, one on either side of curved surface 9. The concave end portion of casing 8 is similar in shape to the concave end portion of stud 2. Curved surface 9 has a diameter which will allow it to accomodate fuel line F. The diameter may be of the same or greater size than the diameter of the curved surface of concave end portion 5. I prefer to make it a little larger and to have only diameter for all fuel lines. Flat surfaces 10 are formed to ensure that there is a gap 6 between the opposing studs of two electromagnetic assemblies when they are installed on a fuel line. See FIGS. 2 and 3.

Gap 6 is needed to increase the magnetic field flux. Gap 6 gives a complete, unbroken, pinpoint magnetic flux field through the fuel as it flows through the fuel line. The strength of the flux is maximum at the end of the stud because of this pinpointing. Gap 6 may be in the range of 1/32" to ¼". If gap 6 is more than ¼", the flux is lost. I prefer a gap of ⅛". My invention may be used on steel, copper, plastic, or rubber fuel lines, as well as brass fuel lines. It is equally efficient on all fuel lines.

Casing 8 protects coil 19 from any physical damage. Casing 8 may be made of any encapsulating material which can stand a temperature of 180° F. For example, epoxy or fiber glass may be used. I prefer epoxy.

Core 1 is pivotally mounted within spool cylinder 17. This allows stud 2 to be turned 360°, if necessary, for adjustment on curved or bent fuel lines.

Figure 5:
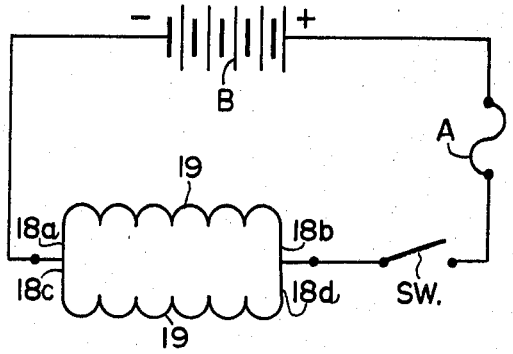
FIG. 5 is a wiring schematic diagram of a 12 volt direct current circuit in which the device may be connected.
Figure 2:
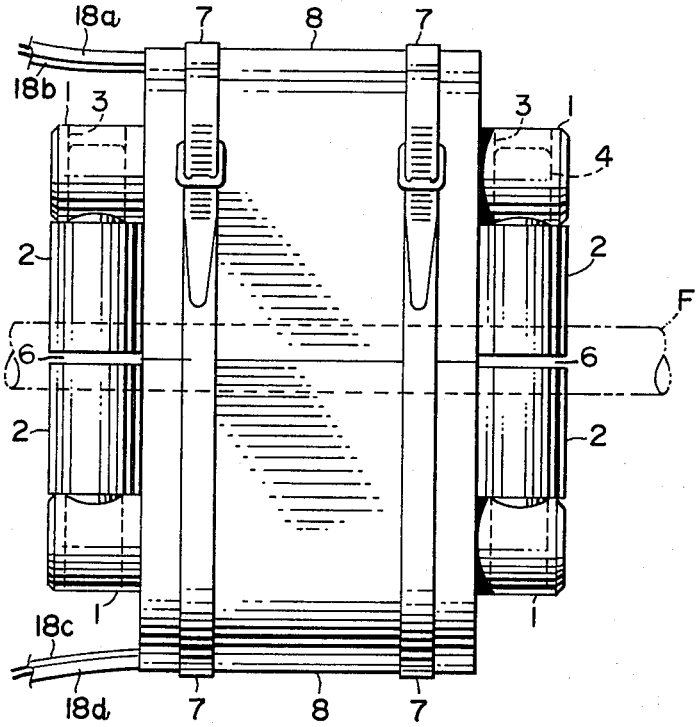
FIG. 2 is a front elevational view of the device installed on a fuel line F.
Figure 3:
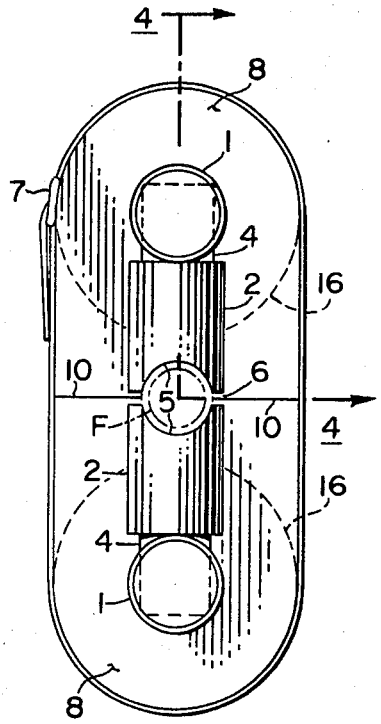
FIG. 3 is a right elevational view of the device shown in FIG. 2.
Figure 4:
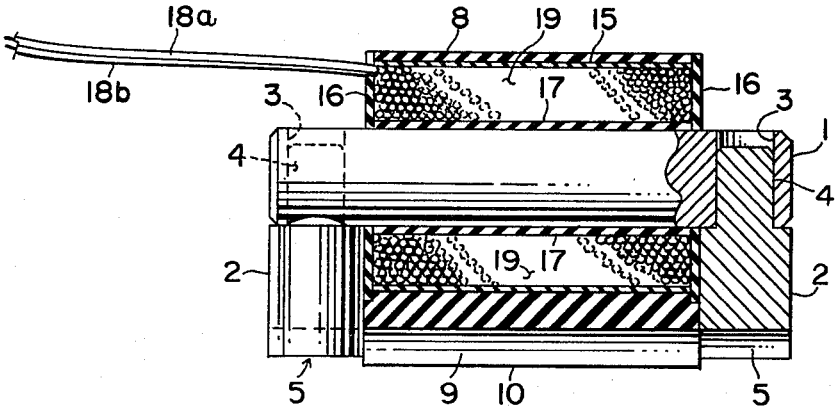
FIG. 4 is a sectional view taken on line 4—4 of FIG. 3 without the fuel line F and the connector. The top half of the device is shown in section except for a portion of the core and the left stud.
Figure 6:
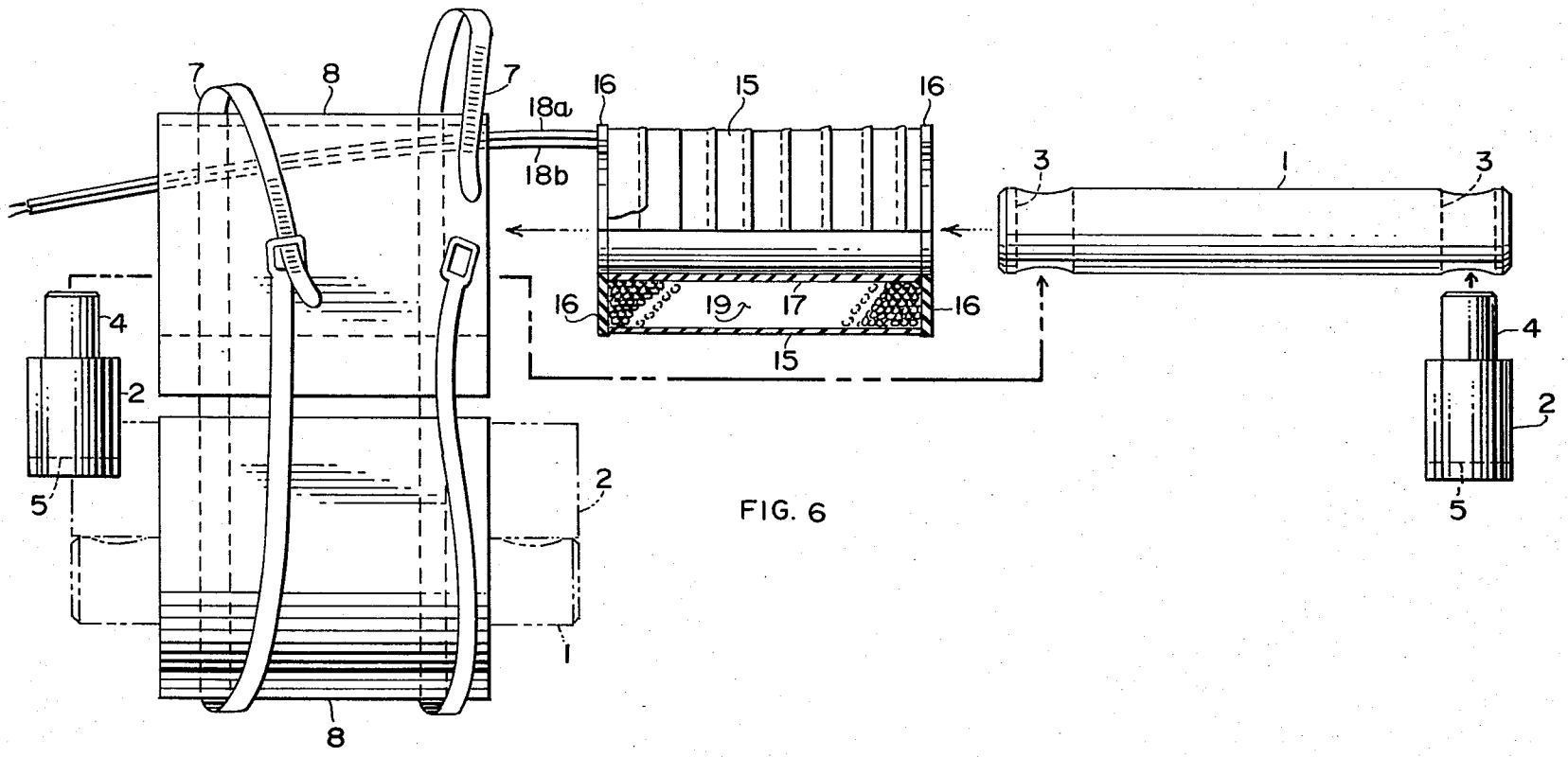
FIG. 6 is an exploded front elevational view of the top half of the device.

Coil 19 is designed to give a maximum flux field with a minimum amount of current draw, approximately 1.5 amperes on a 12 volt direct current system. FIG. 5 is a wiring diagram of a 12 volt direct current circuit in which the leads of coil 19 are shown to be connected in parallel. Reference letters A, B, and S.W., respectively designate a fuse, a battery, and a switch.

Connectors 7 are used to secure two electromagnetic assemblies to fuel line F. Any securing means may be used. For example, straps, cable ties, or stainless steel clamps may be used. I prefer using Ty-Raps, which are plastic straps, because they are easy to obtain and use and are relatively inexpensive. See FIGS. 2 and 6.

My invention may be installed as follows: (1) Align end portions 5 of studs 2 with curved surface 9 of casing 8. (2) Place two electromagnetic assemblies on fuel line F so that the fuel line is within curved surfaces 9. (3) Connect the electromagnetic assemblies with connectors 7. (4) Connect leads 18*a*, 18*b*, 18*c*, and 18*d* in parallel to a 12 volt direct current circuit as shown in FIG. 5.

My invention can be installed anywhere on a fuel line. For example, it may be installed the fuel pump and the carburetor. I prefer to install my invention ahead of the fuel pump as this will allow excess fuel to be polarized before it enters the return line. Since only a small percentage of the fuel pumped goes into the metering section and the excess is constantly being returned to the fuel tank, most of the fuel will pass several times through the polarizing invention's flux field.

By polarizing fuel molecules with an unbroken magnetic flux field, the flash point is lowered to a sufficient degree to eliminate preignition tendencies. This allows the combustion stroke of the engine to receive the complete power of the fuel igniting at the proper time of compression, resulting in additional power. This additional power is sufficient to achieve a significant improvement in fuel economy, plottable by engine displacement and revolutions per minute. Field tests with my invention on various sized gasoline and diesel engines have shown 15% to 30% improvement in fuel efficiency. Greater economy is realized on larger engines and on diesel engines.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. An electromagnetic fuel saving device for an internal combustion engine comprising an electromagnetic assembly which includes a coil, a spool, a coil winding insulating tape, a casing, a core, two studs, and two terminals; the coil is wound around the cylinder of the spool and within its rims; the insulating tape covers the coil; the casing encloses the coil, the insulating tape, and the spool; the casing has a concave end portion; the core is pivotally mounted within the spool cylinder, has two spaced holes located in its end portions, and extends on either side of the spool a distance slightly greater than the width of the stud; the stud has a reduced end portion and a concave end portion and its reduced end portion fits within the hole of the core; the casing is formed so that its concave end portion extends slightly beyond the concave end portion of the stud; and the terminals are connected to the coil and are adapted to be used to operatively connect the coil to a battery.

2. The electromagnetic fuel saving device of claim 1, wherein the concave end portion of the casing includes a curved surface and two flat surfaces, one on either side of the curved surface and the curved surface has a diameter which will accomodate a fuel line.

3. The electromagnetic fuel saving device of claim 2, wherein the concave end portion of the stud includes a curved surface located between two flat surfaces and the diameter of the curved surface will vary with the size of a fuel line to be accomodated.

4. The electromagnetic fuel saving device of claim 3, wherein the coil is a specially wound coil of standard magnet wire with a predetermined number of turns and the spool is a coil winding insulator spool.

5. The electromagnetic fuel saving device of claim 3 in combination with an identical electromagnetic assembly and connecting means, wherein the assemblies are mounted in facing relationship on a fuel line and secured to the fuel line by the connecting means.

6. The electromagnetic fuel saving device of claim 5, wherein the connecting means are Ty-Raps.

7. The electromagnetic fuel saving device of claim 4 in combination with an identical electromagnetic assembly and connecting means, wherein the assemblies are mounted in facing relationship on a fuel line and are secured to the fuel line by the connecting means.

8. The electromagnetic fuel saving device of claim 7, wherein the connecting means are plastic straps.

* * * * *